US008841557B2

(12) United States Patent
Kroushl et al.

(10) Patent No.: US 8,841,557 B2
(45) Date of Patent: Sep. 23, 2014

(54) LAN CABLE WITH PEI CROSS-FILLER

(75) Inventors: Paul Kroushl, Lancaster, PA (US); Thierry Auvray, Charleville Mezieres (FR)

(73) Assignee: Nexans, Paris (FR)

( * ) Notice: Subject to any disclaimer, the term of this patent is extended or adjusted under 35 U.S.C. 154(b) by 169 days.

(21) Appl. No.: 13/205,839

(22) Filed: Aug. 9, 2011

(65) Prior Publication Data

US 2013/0037302 A1 Feb. 14, 2013

(51) Int. Cl.
*H01B 11/02* (2006.01)
*H01B 7/295* (2006.01)

(52) U.S. Cl.
CPC ..... *H01B 7/295* (2013.01)
USPC ..... 174/113 R

(58) Field of Classification Search
CPC ..... H01B 11/04; H01B 11/06
USPC ..... 174/113 R, 113 C, 110 R
See application file for complete search history.

(56) References Cited

U.S. PATENT DOCUMENTS

| | | | | |
|---|---|---|---|---|
| 5,619,016 | A * | 4/1997 | Newmoyer | 174/113 R |
| RE37,010 | E * | 1/2001 | Newmoyer | 174/113 R |
| 6,687,437 | B1 * | 2/2004 | Starnes et al. | 385/101 |
| 6,818,832 | B2 * | 11/2004 | Hopkinson et al. | 174/113 R |
| 7,271,343 | B2 * | 9/2007 | Clark | 174/113 R |

* cited by examiner

*Primary Examiner* — Chau N Nguyen
(74) *Attorney, Agent, or Firm* — Sofer & Haroun, LLP

(57) ABSTRACT

A communications cable has a jacket, a plurality of twisted pairs, each twisted pair having two insulated conductors twisted around one another. A cross-filler is arranged between the twisted pairs where the cross-filler is constructed of PEI (polyetherimide).

5 Claims, 2 Drawing Sheets

LAN CABLE

LAN CABLE WITH PEI CROSS-FILLER

BACKGROUND

1. Field of the Invention

This application relates to cables. More particularly, this application relates to network cable construction.

2. Description of Related Art

Communications cables are broadly grouped into two arrangements, fiber optic cables and metal conductor cables, each of which has their own unique set of construction parameters that affect the quality of the communication signals carried therethrough.

Regarding metal conductor cables, one typical arrangement is the LAN (Local Area Network) cable that is usually constructed of four pairs of twisted insulated copper conductors encased within a jacket. Other larger cables may employ more pairs of conductors.

In this typical four pair LAN cable construction, in addition to the outer jacket, each of the eight primary conductors are individually coated with an insulation layer. Among the other components, LAN cables often include a cross-filler for better NEXT (Near End Cross Talk) performance. An exemplary LAN cable with a cross filler is shown in prior art FIG. 1. In each case, aside from electrical performance considerations, there are certain mechanical performance tests that need to be met. One such crucial test is the NFPA 262 flame test, which is a standard method of testing for flame travel and smoke generation for testing wires and cables that may be installed in air-handling spaces such as building ductwork.

In this context, FEP (Fluorinated Ethylene Polymer) resin, thanks to its outstanding electrical and flame performance, is a typical material choice for the LAN cable application. Aside from its use as the insulation on the primary conductors of the twisted pairs, FEP is also the currently the ideal choice for the material of the cross fillers as it has excellent electrical properties and good flame and smoke performance. Alternative prior art arrangements have used mixtures of LDPE and VLDPE (Low Density and Very Low Density Polyethylene) with flame retardant fillers

OBJECTS AND SUMMARY

However FEP resin is expensive and the source of supply is limited, thus alternative materials are desirable, provided they meet the required flame and mechanical considerations. Regarding the filled LDPE and VLDPE, although the fillers are able to bring the cross filler up to the necessary fire/smoke tests, the fillers end up reducing the mechanical properties and make extrusion more difficult.

To that end a communications cable having a jacket, a plurality of twisted pairs, each twisted pair having two insulated conductors twisted around one another. A cross-filler is arranged between the twisted pairs where the cross-filler is constructed of PET (polyetherimide).

BRIEF DESCRIPTION OF THE DRAWINGS

The present invention can be best understood through the following description and accompanying drawings, wherein.

DETAILED DESCRIPTION

Figure 1:
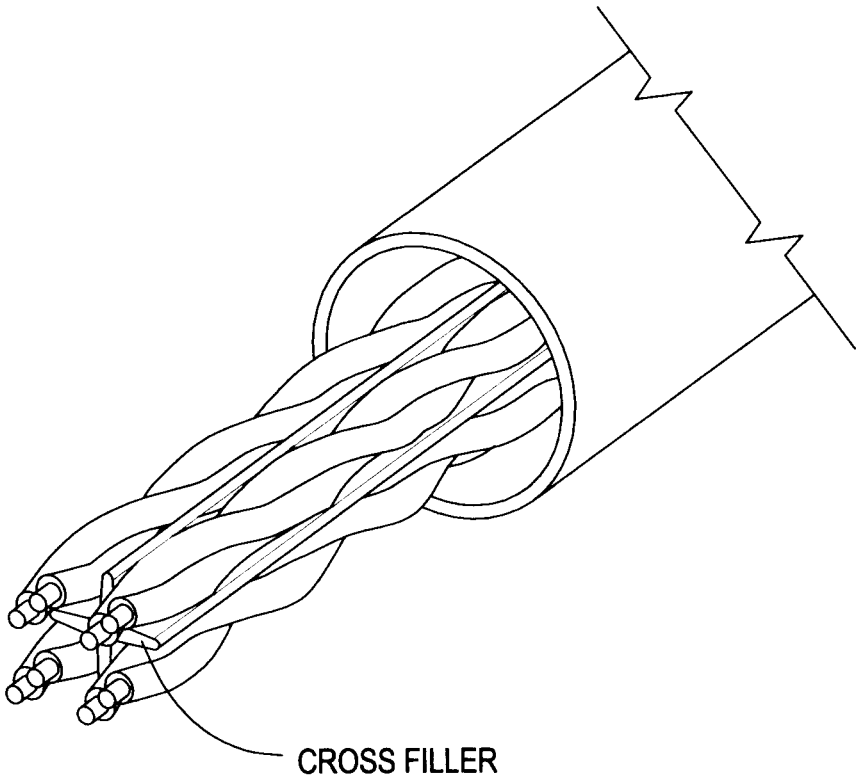
FIG. 1 (PRIOR ART)
FIG. 1 shows a prior art LAN cable with a crass-filler.

In one embodiment as illustrated in FIG. 1, a LAN (Local Area Network) cable 10 is shown. For the purposes of illustration, the salient features of the present arrangement are described in the context of a LAN cable, however, the invention is not limited in this respect. Other cables that require meeting certain flame test requirements may also employ the present technology.

As shown in FIG. 1, LAN cable 10 has a jacket 12 constructed for example from FRPVC (Flame Retardant Poly-Vinyl Chloride). Within jacket 12 there are four twisted pairs 20. Each twisted pair is formed of two primary conductors 22 twisted around one another. As shown in FIG. 1 primary conductors 22 are typically made from a copper wire conductor 23 covered with an insulation layer 24.

In the present arrangement, the polymer material used for insulation layers 24 may be made from FRPVC, FEP (Fluorinated Ethylene Polymer), FRPP (Flame Resistant Poly Propylene), PEI (polyetherimide), PES (Poly(ether sulfones) and PPS (Polyphenylene Sulfide). Optionally, some of the insulation layers 24 on some of the pairs 20 may be made from a first polymer such as FEP, with other insulation layers 24 on some of the pairs 20 being made from FR olefins such as FRPP in order to balance flame/smoke properties, mechanical properties and costs. It is understood that any selection of insulation material for insulation layers 24 on pairs 20 is within the contemplation of the present invention.

For example, in one arrangement, insulation layer 24 on two twisted pairs 20 are made from a flame resistant olefin composition, preferably, FRPP (Flame Resistant Poly Propylene) and the other two insulation layers 24 on the remaining two twisted pairs 20 are made from a FEP.

In another example, insulation layer 24 on two twisted pairs 20 are made from a flame resistant olefin composition, preferably, FRPP and the other two insulation layers 24 on the remaining two twisted pairs 20 are made from a flame resistant imide polymer, such as PEI (polyetherimide).

Flame Resistant Polyolefins, and in particular FRPP is significantly less expensive than either the normal prior art FEP and PEI. However, although it is flame/smoke resistant, it is not as flame smoke resistant as either FEP or PEI.

Figure 2:
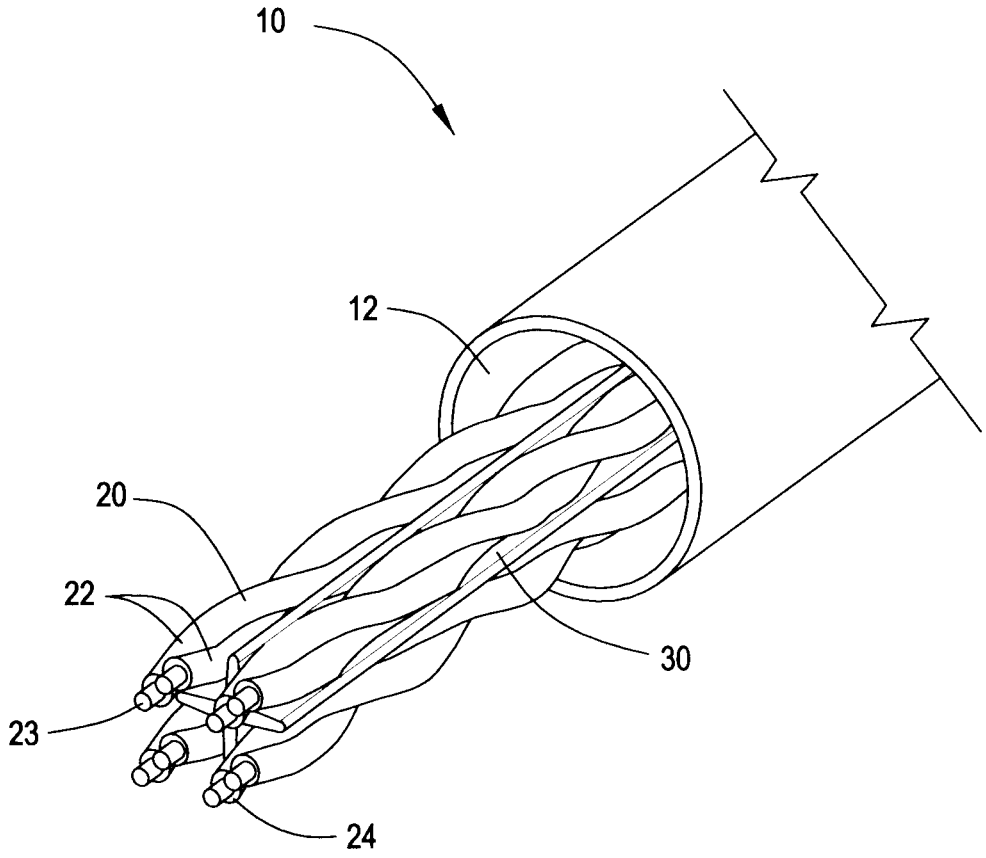
FIG. 2 shows a LAN cable with a cross-filler according to the present arrangement.

As illustrated in FIG. 2, in addition to the twisted pairs 20, cable 10 also has a cross filler 30 made from PEI. In this context PEI has excellent flame and smoke performance as well as good electrical properties to reducing NEXT (Near End Cross Talk). Moreover, although PEI in general tends to be stiffer than FEP or other typical polymers, the present Applicants have found that cables manufactured with PET cross filler 30 exhibits flexibility characteristics similar to those of cables manufactured with the FR olefin cross fillers.

As such, in another embodiment, the present arrangement contemplates the use of additives to the PEI in order to improve metal release, processibility, aging, or flame and smoke performance, the PEI may contain organic and/or inorganic additives. In one example, the PEI may be a copolymer of polyetherimide (PEI) and siloxane. Such copolymer resins have flexibility characteristics that may provide advantages relatice to typical PEI resins. In another example, PEI resins containing plasticizers can be used to reduce product stiffness. This can be in addition to the arrangement and selection of insulation 24, such as FRPP for pairs 20 to balance the stiffness of the overall cable 10.

Based on these combined factors, according to one arrangement, as discussed above insulation 24 on two or more twisted pairs 20 may made from FRPP which has good electrical properties and good mechanical properties while providing a low cost solution to provide FR insulation on primary conductors 22. In order to provide improved smoke/fire resistance, one or more pairs 20 of primary conductors 22 are insulated with PEI with the cross filler also being made of PEI as well. This adds very high fire resistance with the result that overall cable 10 is able to meet the required NFPA 262 flame test without the use of any FEP. The added stiffness from using PEI on pairs 20 and cross filler 30 can be offset by the flexibility of pairs 20 insulated with FRPP and thus does not significantly impair the flexibility of cable 10.

Turning to test results for the present arrangement, the above described NFPA 262 flame test is applied to cables, such as cable 10, intended for use within buildings inside of ducts, plenums, or other spaces used for environmental air distribution. Any cable used in these areas must be "plenum rated" in order to be installed without conduit. On such plenum rating test is the NFPA 262 test. In order to pass the NFPA 262 test, these cables must have outstanding resistance to flame spread and generate low levels of smoke during combustion. As noted above, this smoke spread factor is directly related to the use of insulation on cable 10, and in particular the insulation used on twisted pairs 20. Because of the need to use low smoke insulation, these plenum rated cables are the highest in cost of the three major premise data communications cable types specified by the NEC (National Electric Code).

The NFPA 262 flame test uses a test apparatus called a Steiner Tunnel. This chamber is 25' long by 18 inches wide by 12 inches high. An 11.25 inch wide tray is loaded with a single layer of cable, such as cable 10 placed side to side against each other so that the width of the tray is filled. The cable is then exposed to a 300,000 btu flame for 20 minutes. During the course of the test, the flame must not propagate more than 5 feet, the peak smoke must not exceed a value of 0.5 (log Io/I), and the average smoke value must not exceed 0.15 (log Io/I). It is noted that log Io/I refers to the optical density where I is the intensity of light at a specified wavelength $\lambda$ that has passed through a sample (transmitted light intensity) and $I_0$ is the intensity of the light before it enters the sample or incident light intensity (or power). If the cable is tested twice meets all three criteria after each test, it is deemed to have passed the test.

To show the effectiveness of cable 10, cross filler 30 made from PEI was tested against a prior art cross filler made from a FR olefin. As a control, in each case, the outer jacket was made from FRPVC, two of the pairs were insulated with FEP and two of the pairs were insulated with FR olefin.

The following table 1 shows the results of the NFPA 262 test:

TABLE 1

| | Test # | Flame Spread | Peak Smoke | Average Smoke |
|---|---|---|---|---|
| PEI Crossfiller | 1 | 1.5 | 0.33 | 0.07 |
| PEI Crossfiller | 2 | 2.0 | 0.26 | 0.09 |
| FR Olefin Crossfiller | 1 | 4.0 | 0.52 | 0.12 |

TABLE 1-continued

| | Test # | Flame Spread | Peak Smoke | Average Smoke |
|---|---|---|---|---|
| FR Olefin Crossfiller | 2 | 5.0 | 0.36 | 0.11 |
| FR Olefin Crossfiller | 3 | 3.0 | 0.34 | 0.12 |

As seen from the above Table 1, PEI cross filler 30 exhibited improved performance in all test criteria versus a similarly arranged FR olefin cross filler, while being significantly less costly than an FEP cross filler. Such a cross filler 30 may be used in a cable 10, in place of either FR olefin cross fillers to provide better performance or in place of FEP cross fillers to save significant costs while maintaining the comparable performance.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A communications cable, said cable comprising:

a polymer jacket;

four twisted pairs, each twisted pair having two polymer insulated conductors twisted around one another wherein at least one of said four twisted pairs is insulated with an (Fire Resistance) olefin polymer and wherein at least another one of said four twisted pairs is insulated with PEI (polyetherimide); and a cross-filler arranged between said four twisted pairs, wherein said cross-filler is constructed of PEI (polyetherimide), wherein combination said polymers forming said insulation of said twisted pairs and said PEI polymer of said cross-filler are such that said communication cable meets the NFPA 262 flame test while simultaneously the stiffness of the cable caused by said PEI cross-filler is offset by said polymers forming said insulation of said twisted pairs so as not to impair the flexibility of said cable.

2. The communications cable as claimed in claim 1, wherein said polymer jacket is constructed of FRPVC (Flame Retardant Poly-Vinyl Chloride).

3. The communications cable as claimed in claim 1, wherein two of said four twisted pairs are insulated using FR olefin.

4. The communications cable as claimed in claim 3, wherein two of said four twisted pairs are insulated using PEI (polyetherimide).

5. The communications cable as claimed in claim 1, wherein said cable is constructed such that it includes a combination of twisted pairs insulated using PEI (polyetherimide) and twisted pairs insulated using FR olefin for said four twisted pairs, combined with said PEI cross filler so as to pass the NFPA 262 flame test.

* * * * *